US011047130B2

(12) United States Patent
Ramirez

(10) Patent No.: US 11,047,130 B2
(45) Date of Patent: Jun. 29, 2021

(54) SYSTEMS AND METHODS FOR A WALL PARTITION APPARATUS

(71) Applicant: Casey Ramirez, Tucson, AZ (US)

(72) Inventor: Casey Ramirez, Tucson, AZ (US)

( * ) Notice: Subject to any disclaimer, the term of this patent is extended or adjusted under 35 U.S.C. 154(b) by 0 days.

(21) Appl. No.: 16/539,902

(22) Filed: Aug. 13, 2019

(65) Prior Publication Data

US 2021/0047831 A1 Feb. 18, 2021

(51) Int. Cl.
*E04B 2/74* (2006.01)

(52) U.S. Cl.
CPC .... *E04B 2/7442* (2013.01); *E04B 2002/7479* (2013.01); *E04B 2002/7496* (2013.01); *E04B 2103/04* (2013.01)

(58) Field of Classification Search
None
See application file for complete search history.

(56) References Cited

U.S. PATENT DOCUMENTS 3,822,850 A * 7/1974 Elias ..... E04H 17/18 248/551
3,850,401 A * 11/1974 Snediker ..... A47B 97/02 248/292.13
4,139,101 A * 2/1979 Towfigh ..... A47G 5/00 160/336
5,924,469 A * 7/1999 Whittemore ..... E04G 21/24 160/368.1
6,134,844 A * 10/2000 Cornell ..... E04B 2/827 160/330
6,923,141 B1 * 8/2005 Staats ..... G09F 17/00 116/173
7,789,927 B2 * 9/2010 Tramontina ..... E04G 21/243 55/491
8,122,629 B2 * 2/2012 Cowgill ..... G09F 15/0062 40/610
10,154,611 B2 * 12/2018 Ross ..... H05K 7/1497
2009/0007529 A1 * 1/2009 Tramontina ..... E04G 21/30 55/356

* cited by examiner

*Primary Examiner* — Joshua K Ihezie
(74) *Attorney, Agent, or Firm* — Polsinelli PC

(57) ABSTRACT

A wall partition apparatus includes a body in communication with a base. The body defines a plurality of poles in telescoping arrangement relative to one another. A plurality of arms is in communication with the body and configured to extend horizontally relative to the body. Each of the plurality of arms is engaged to a curtain that deploys to form an overall wall shape configuration.

18 Claims, 6 Drawing Sheets

SYSTEMS AND METHODS FOR A WALL PARTITION APPARATUS

FIELD

The present disclosure generally relates to a portable telescoping partition apparatus having various elements that accommodate adjustment in both height and width without requiring mounting or attachment to a structure or surface.

BACKGROUND

Partition walls are known for dividing or separating spaces within a room or area as needed for privacy. Usually these partition walls are attached to a fixed structure or some other fixed supporting means. These walls are assembled in various ways. Some require the partition wall to be mounted to the ceiling of a room. These require intensive labor and a large space for storage. Other types include a partition wall that can be unfolded, similar to an accordion style fold that remains standing when not completely folded. However, this version is not very stable, as there isn't any support to the partition wall and the apparatus can fall over easily. Partition walls currently available either require installation into a structure, a large space to store the partition wall, or, in the case of the foldable partition wall version, gentle usage.

It is with these observations in mind, among others, that various aspects of the present disclosure were conceived and developed.

BRIEF DESCRIPTION OF THE DRAWINGS

Corresponding reference characters indicate corresponding elements among the view of the drawings. The headings used in the figures do not limit the scope of the claims.

DETAILED DESCRIPTION

Conventional technology related to telescoping partitions does not sufficiently address the issues of the labor required for installation of the telescoping partition to a fixed structure or surface, the excessive storage requirements for walls of the telescoping partition, fixed installation requirements, or lack of portability, and occasional lack of stability. In view of the above considerations, the present inventive concept solves, singly or in combination, these issues in a number of novel ways.

Specifically, the present disclosure relates to a portable partition apparatus. The partition apparatus generally includes a body defining a plurality of polls in telescoping arrangement relative to one another. The body is mounted along a base which may include a plurality of legs capable of folding relative to the base. In addition, a plurality of arms is defined along lateral sides of the body that extend or retract to deploy one or more curtains. The portability of the partition apparatus accommodates use in a wide variety of locations. The partition apparatus can be condensed through telescoping means in order to be stored in a small location, and can be carried and placed where needed. The present invention does not require intensive labor for installation, nor does it require attachment or installation to a structure or surface. The partition apparatus simply needs to be placed where the user desires to use the apparatus and expand it or otherwise deploy it as needed. Because of the ability of the partition apparatus to expand and contract through telescoping means, it can be transported easily. While the partition apparatus does not require attachment to a fixed structure, the apparatus comprises a flat base with an additional adjustable means for added stability and support of the apparatus. Further, the partition apparatus does not require intensive labor for installation. It does not require attachment to a structure or installation to a surface. The partition apparatus can simply be placed where the user desires and expanded as needed.

Figure 1A:
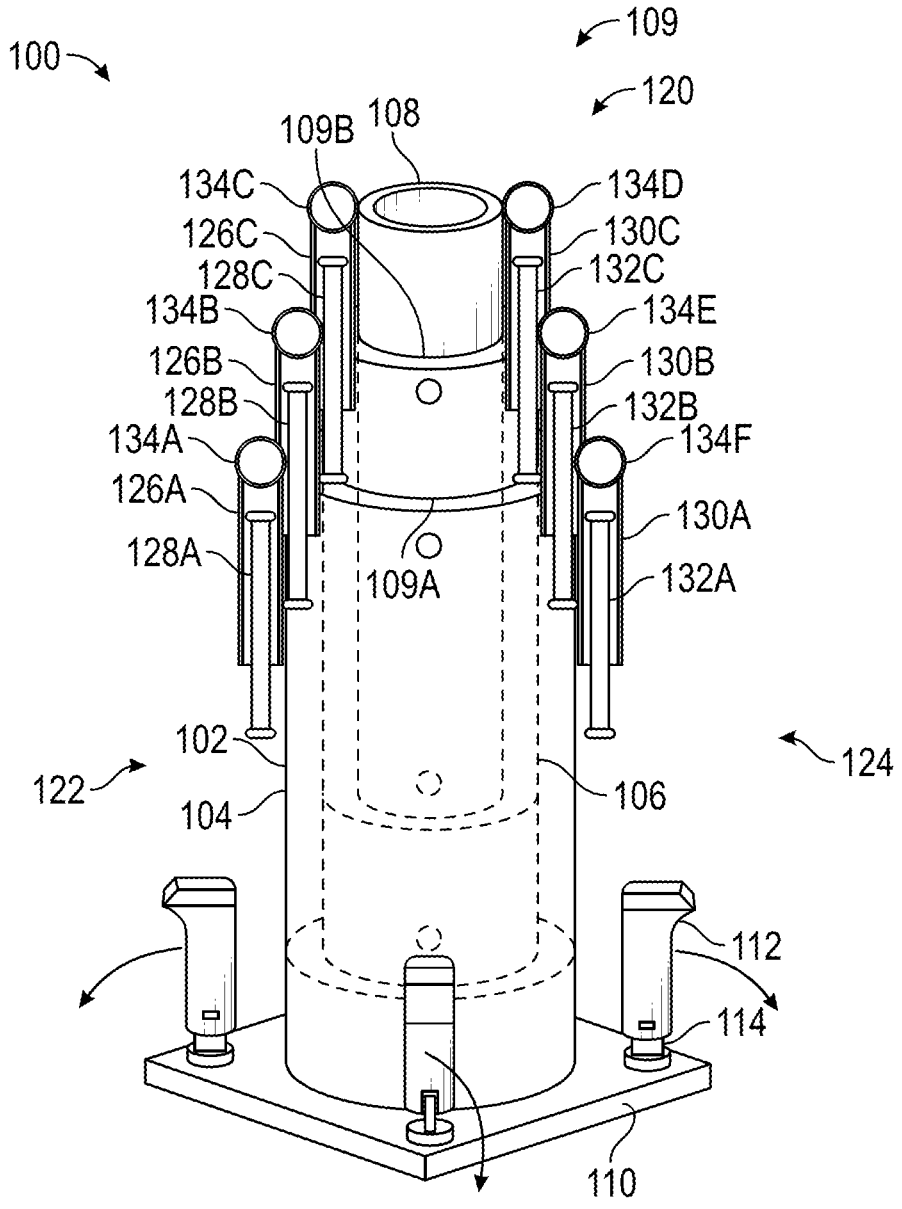
FIG. 1A is a front view of an embodiment of a telescoping partition apparatus in a fully collapsed configuration.

Referring to FIG. 1A, a first embodiment of a partition apparatus 100 is illustrated. As indicated, the partition apparatus 100 generally includes a body 102 defining a first pole 104, a second pole 106, and third pole 108 in telescoping arrangement with one another, and further defining a plurality of openings 109 along the body 102. More specifically, the first pole 104 may define an opening 109A extending vertically through the first pole 104, configured to slidably receive the second pole 106; and the second pole 106 may define an opening 109B extending vertically through the second pole 106, configured to slidably receive the third pole 108. In this manner, the overall height of the body 102 may be adjusted telescopically by sliding the second pole 106 through the opening of the first pole 104 to adjust the position of the second pole 106 relative to the first pole 104 as desired, and by sliding the third pole 108 through the opening of the second pole 106 to adjust the position of the third pole 108 relative to the second pole 106 as desired. In FIG. 1, the body 102 is shown in at least a partially collapsed configuration, such that the second pole 106 is at least partially disposed within the opening 109A and surrounded by the first pole 104, and the third pole 108 is at least partially disposed within the opening 109B and surrounded by the second pole 106. The poles 104, 106, and 108 of the body 102 may be maintained in fixed positions relative to one another using any number or type of fasteners, friction, and the like.

Figure 3:
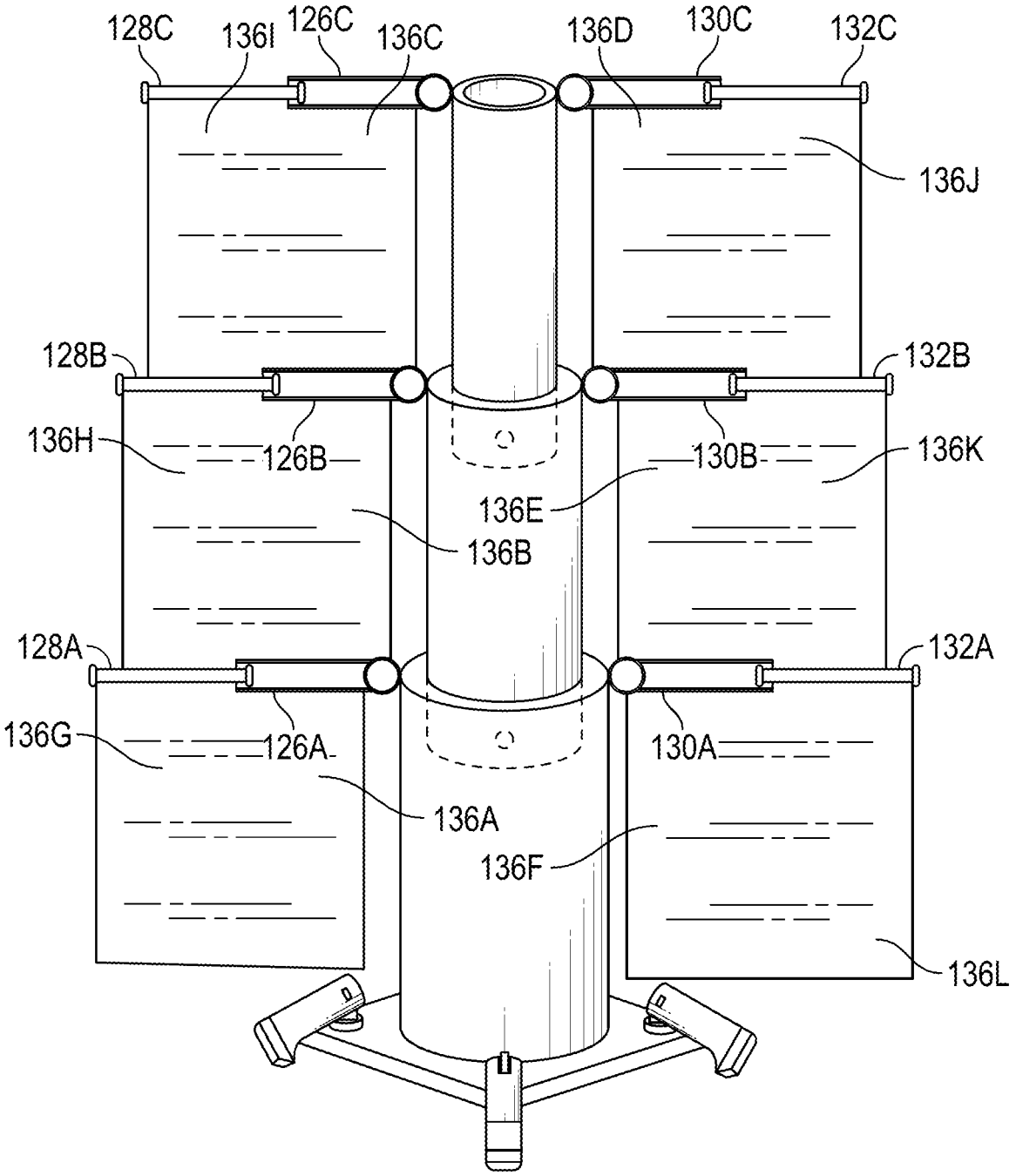
FIG. 3 is a front view of the telescoping partition apparatus of FIG. 1A with the inner arms fully extended and the partition wall curtain fully extended in a second deployed configuration.

As further shown, the first pole 104 of the body 102 is in communication with and generally maintains a fixed position relative to a base 110 which is generally planar and configured to rest along a floor or other surface. The body 102 may be extended telescopically in a vertical direction D1 (FIG. 1B) relative to the base 110 or collapsed as described herein. In some embodiments as shown, a plurality of legs 112 may be coupled to a top surface 110A of the base 110 proximate to the first pole 104. Each of the legs 112 may be aligned along respective corners of the base 110 as shown, and may be configured via respective hinges 114 to rotate or swivel relative to the base 110. In FIG. 1A, for example, the legs 112 are positioned in a vertical orientation parallel to the body 102. However, manipulating the legs 112 using the hinges 114 may accommodate repositioning of the legs 112 relative to the base 110 such that the legs 112 are oriented in a direction at least partially opposite the body 102 (as shown in FIG. 3); e.g., adjacent a bottom surface 1108 of the base 110 opposite the top surface 110A. In this manner, the legs 112 may engage a floor or other surface where the apparatus 100 is deployed.

Figure 1B:
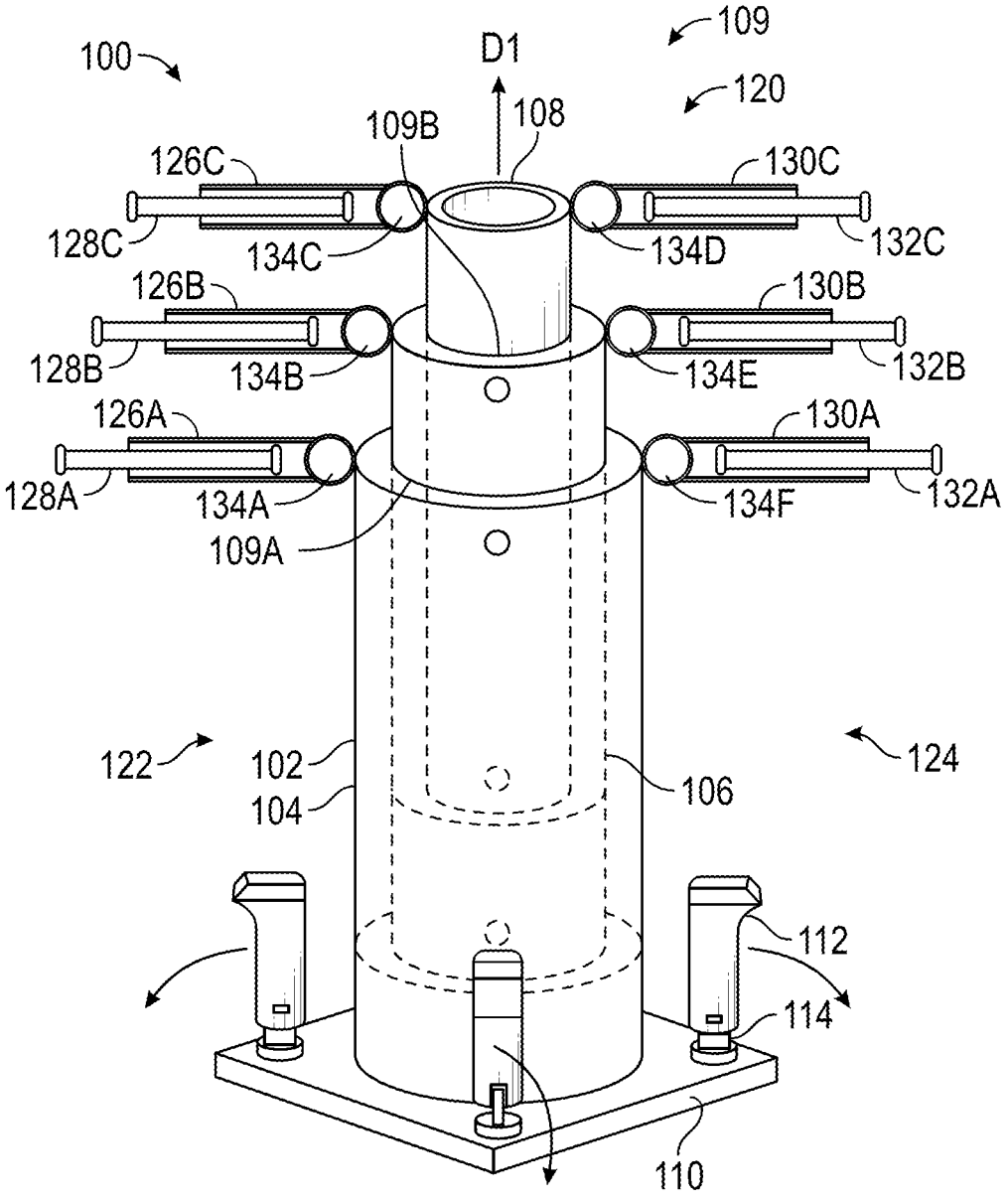
FIG. 1B is a front view of the embodiment of FIG. 1A in a partially collapsed configuration.

As further shown in FIG. 1A, the partition apparatus 100 may include a plurality of arms 120. The arms 120 may be arranged along opposing lateral sides of the body 102 and extend horizontally relative to the body 102 as shown in FIG. 1B, along a single side, or along more than one side of the body 102. In the embodiment shown, a first set 122 of the arms 120 is arranged a long a first side of the body 102 as shown, and a second set 124 of the arms 120 is arranged along a second side of the body 102 and generally oriented in a direction opposite the first set 122 of the arms 120.

The first set 122 of the arms 120 may include a plurality of outer extension arms 126, labeled outer extension arm 126A, outer extension arm 126B, and outer extension 126C, which may be arranged along the body 102 as desired. In some embodiments, the outer extension arm 126A may be coupled to the first pole 104 of the body 102 and may be configured to extend in a perpendicular or orthogonal direction relative to the body 102, the outer extension arm 126B may be coupled to the second pole 106 and may be configured to extend in a perpendicular direction relative to the body 102, and the outer extension arm 126C may be coupled to the third pole 108 and may be configured to extend in a perpendicular direction relative to the body 102. Each of the extension arms 126A-126C may define a proximal end 127A coupled to or at least positioned along the body 102 and a distal end 127B opposite the first end 127A, as demonstrated by and notated with respect to the extension arm 126A.

Further, each of the outer extension arms 126A-126C may telescopically or slidably receive at least one of a plurality of inner extension arms 128 (labeled individually as inner extension arms 128A-128C); i.e., the outer extension arm 128A may receive and be engaged to an inner extension arm 128A, the outer extension arm 126B may receive and be engaged to an inner extension arm 128B, and the outer extension arm 126C may receive and be engaged to an inner extension arm 128C. In this embodiment, the inner extension arms 128 are configured to telescopically slide in and out of the respective outer extension arms 126 to adjust the position of the components relative to one another as desired. In an extended or deployed configuration, each of the inner extension arm 128A, inner extension arm 128B, and inner extension arm 128C is at least partially extended outside the outer extension arm 126A, outer extension arm 126B, and outer extension arm 126C respectively, so as to increase an overall length of the first set 122 of the arms 120; i.e., increase the total width of the apparatus 100. In other words, for example, the inner extension arms 128A-128C may generally extend from the distal ends of the respective outer extension arms 126A-126C such that the inner extension arms 128A-128C and the outer extension arms 126A-126C generally extend orthogonally relative to the body 102.

In a similar manner, the second set 124 of the arms 120 may include a plurality of outer extension arms 130, labeled outer extension arm 130A, outer extension arm 130B, and outer extension arm 130C, which may be arranged along the body 102 as desired. In some embodiments, the second set 124 of the arms 120 may be arranged opposite the first set 122 of arms 120 such that outer extension arm 130A is directly opposite outer extension arm 126A, outer extension arm 130B is directly opposite outer extension arm 126B, and outer extension arm 130C is directly opposite outer extension arm 126C. In some embodiments, the outer extension arm 130A may be coupled to the first pole 104 of the body 102 and may be configured to extend in a perpendicular direction relative to the body 102, the outer extension arm 130B may be coupled to the second pole 106 and may be configured to extend in a perpendicular direction relative to the body 102, and the outer extension arm 130C may be coupled to the third pole 108 and may be configured to extend in a perpendicular direction relative to the body 102. Further, the outer extension arms 130A-130C may telescopically receive, respectively, at least one of a plurality of inner extension arms 132; i.e., the outer extension arm 130A may receive labeled inner extension arm 132A, inner extension arm 132B, and inner extension arm 132C. In this embodiment, the inner extension arms 132A-132B are configured to telescopically slide in and out of the respective outer extension arms 130A-130C to adjust the position of the components relative to one another as desired. In an extended configuration, each of the inner extension arm 132A, inner extension arm 132B, and inner extension arm 132C is at least partially (or fully) extending outside the outer extension arm 130A, outer extension arm 130B, and outer extension arm 130C respectively, so as to increase an overall length of the second set 124 of the arms 120; i.e., increase the total width of the apparatus 100.

In some embodiments as indicated, each of the plurality of arms 120 may be configured to change orientation relative to the body 102 via joints 134. Specifically, the joints 134 may be defined along the arms 120 and may accommodate changes in orientation of the first set 122 of the arms 120 or the second set 124 of the arms 120 relative to the body 102. For example, the joints 134, labeled joints 134A-134F, may include ball-and-socket joints or hinge joints, so that the first set 122 and/or the second set 124 of the arms 120 may be oriented in a direction opposite D1, towards the base 110 as shown in FIG. 1, to decrease the horizontal profile of the apparatus 100 for storage, transport or other applications.

Figure 2:
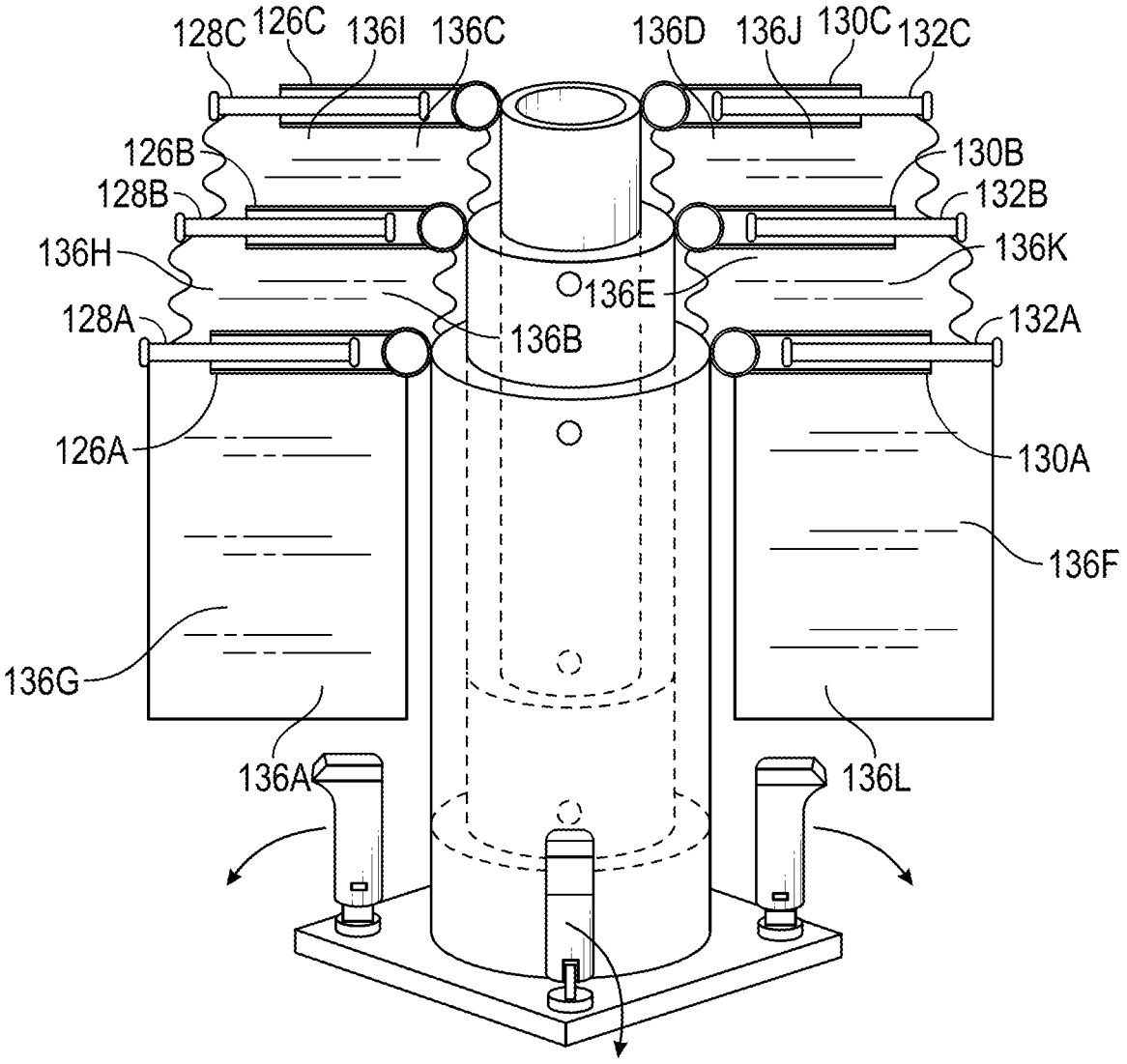
FIG. 2 is a front view of the telescoping partition apparatus of FIG. 1A with the partition wall curtain extended in a first deployed configuration.

Referring to FIG. 2 a set of wall curtains 136A-136L may be included and deployed with the partition apparatus 100. In other words, the first set 122 of arms 120 and the second set 124 of arms 120 are configured to suspend and release the set of wall curtains 136A-136L. In this embodiment, wall curtain 136A is attached to the outer extension arm 126A, wall curtain 136B is attached to the outer extension arm 126B, wall curtain 136C is attached to the outer extension arm 126C, wall curtain 136D is attached to the outer extension arm 130C, wall curtain 136E is attached to the outer extension arm 130B, and wall curtain 136F is attached to the outer extension arm 130A. Likewise, wall curtain 136G is attached to inner extension arm 128A, wall curtain 136H is attached to inner extension arm 128B, wall curtain 136I is attached to inner extension arm 128C, wall curtain 136J is attached to inner extension arm 132C, wall curtain 136K is attached to inner extension arm 132B, and wall curtain 136L is attached to inner extension arm 132A. The set of wall curtains 136A-136L may be made of a fabric or tarp material which may be opaque or partially opaque, any other material capable of obstructing a view.

In some embodiments, the wall curtains 136 are arranged along the apparatus 100 such that wall curtains 136A-136F are attached to the outer extension arms 126A-126C and 130A-130C, and wall curtains 136G-136L are attached to the inner extension arms 128A-128C and 132A-132C in the manner shown (FIG. 2 and FIG. 3). The wall curtains 136A-136L may be held in a suspended, compressed state using one or more springs and/or clips, hooks, or a hook and loop material. When deployed and completely unfurled, the wall curtains 136 may be of the same lengths or different lengths, and may be of the same widths or different widths. For example, in some embodiments, wall curtains 136G-136L may be of a shorter width or length than wall curtains 136A-136F. In other embodiments, the length of each of the set of wall curtains 136A-136L is progressively shorter the higher in elevation relative to the base 110. For example, in some embodiments curtain 136A may be longer than curtain 136B which may be longer than curtain 136C. In some embodiments the wall curtains 136 may be configured to layer when unfurled such that, for example, curtain 136A is layered in front of curtain 136B which is layered in front of curtain 136C.

In FIG. 2, the partition apparatus 100 is shown in a partially deployed configuration in which the set of wall curtains 136A-136F are completely unfurled (fully deployed) and the inner extension arms 128A-128C and 132A-132C are partially deployed from the outer extension arms 126A-126C and 130A-130C such that some but not all of each inner extension arm is recessed within its respective outer extension arm. Further, the wall curtains 136G-136L, which are represented in phantom, are furled about the inner extension arms 128A-128C and 132A-132C or are otherwise not yet deployed. In the embodiment shown, the outer extension arms 126A-126C and 130A-130C, and inner extension arms 128A-128C and 132A-132C are oriented in perpendicular relation relative to the body 102. In some embodiments, the set of wall curtains 136A-136L may be attached to the first set 122 and second set 124 of arms 120 by hooks, clips, or a hook and loop material and configured to fully detach from the first set 122 and second set 124 of the arms 120. In other embodiments, the set of wall curtains 136A-136L may be coupled to the first set 122 and second set 124 of arms 120 by an adhesive material or be molded to the first set 122 and second set 124 of arms 120. In other embodiments each of the set of wall curtains 136A-136L may be configured to be compressed (using springs or other similar means) when the partition apparatus 100 is partially deployed such that each of the set of wall curtains 136A-136L does not unfurl to its full length.

Referring to FIG. 3, the partition apparatus 100 is shown in a fully deployed configuration in which the set of wall curtains 136A-136L are all unfurled and the inner extension arms 128A-128C and 132A-132C are fully deployed from the outer extension arms 126A-126C and 130A-130C such that most or all of the entire length of each inner extension arm extends outward from its respective outer extension arm. In addition, the outer extension arms 126A-126C and 130A-130C, and inner extension arms 128A-128C and 132A-132C are oriented perpendicular to the body 102 as shown. In this manner, the first set 122 of arms 120 and the second set 124 of arms 120 are configured to suspend and release the set of wall curtains 136A-136L to form the configuration shown. When the partition apparatus 100 is in this fully deployed configuration, wall curtains 136A-136L may be extended to their full length and width. Further, FIG. 3 depicts the first pole 104, the second pole 106, and the third pole 108 fully deployed such that the second pole 106 extends fully from the opening 109A and is at least partially surrounded by the first pole 104, and the third pole 108 extends fully from the opening 109B and is at least partially surrounded by the second pole 106. When the partition apparatus 100 is oriented in such a fully deployed state, the legs 112 may be adjusted to provide stability to the partition apparatus 100 by being oriented away from the body 102 at least partially deployed beneath the base 110.

Figure 4:
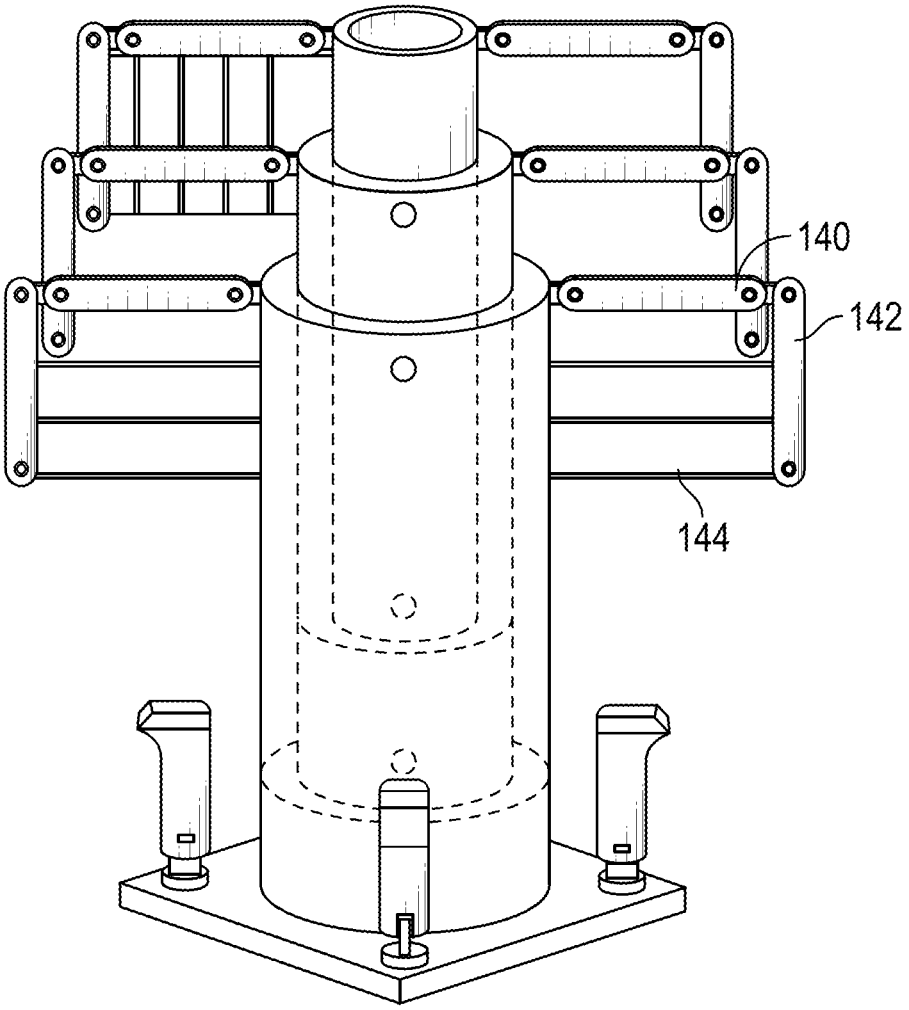
FIG. 4 is a front view of another embodiment of the telescoping partition apparatus oriented in a partially deployed configuration wherein the hinged inner arms are bent to form a 90 degree L-shape configuration and the partition wall curtain is partially extended.

Referring to FIG. 4, another embodiment of the partition apparatus 100 is shown in which the telescoping body 102 includes adjustable partition top frames 140A-140C and 142A-142C rather than outer extension arms 126A-126C and 130A-130C. The adjustable partition top frames 140A-140C and 142A-142C may be attached to the telescoping body 102 by hinges 144A-144F such that, for example, top frame 140A is attached to the telescoping body 102 by hinge 144A. In this embodiment, the adjustable partition top frames 140A-140C and 142A-142C are depicted in a perpendicular orientation to the telescoping body 102 but may be rotated from the hinges 144A-144F up to a 180 degree angle. FIG. 4 further shows a set of adjustable partition side frames 146A-146C and 148A-148C rather than inner extension arms 128A-128C and 132A-132C. The adjustable partition side frames 146A-146C and 148A-148C may be attached to the adjustable partition top frames 140A-140C and 142A-142C by a second set of hinges 150A-150F such that, for example, side frame 146A is attached to top frame 140A by hinge 150A. In this embodiment, the adjustable partition side frames 146A-146C and 148A-148C may be configured to rotate about the second set of hinges 150A-150F up to 360 degrees in relation to the adjustable partition top frames 140A-140C and 142A-142C, such that, for example, side frame 146A may be rotated 360 degrees about hinge 150A relative to the top frame 140A.

FIG. 4 further illustrates the partition apparatus 100 in a partially deployed configuration in which a first set of wall curtains 152A-152F are shown suspended or otherwise partially deployed from the adjustable partition top frames 140A-140C and 142A-142C, and a second set of wall curtains 154A-154F, represented in phantom, are shown furled around the adjustable partition side frames 146A-146C and 148A-148C or otherwise not fully deployed. In this embodiment, the first set of wall curtains are arranged such that wall curtain 152A is suspended from top frame 140A, wall curtain 152B is suspended from top frame 140C, wall curtain 152C is suspended from top frame 140C, wall curtain 152D is suspended from top frame 142A, wall curtain 152E is suspended from top frame 142B, and wall curtain 152F is suspended from top frame 142C. Further, wall curtain 154A is furled around side frame 146A, wall curtain 154B is furled around side frame 146B, wall curtain 154C is furled around side frame 146C, wall curtain 154D is furled around side frame 148A, wall curtain 154E is furled around side frame 148B, and wall curtain 154F is furled around side frame 148C.

FIG. 4 further depicts the first pole 104, the second pole 106, and the third pole 108 partially deployed such that the second pole 106 extends partially but not fully from the opening 109A and is at least partially surrounded by the first pole 104, and the third pole 108 extends partially but not fully from the opening 109B and is at least partially surrounded by the second pole 106. When the partition apparatus 100 is in the partially deployed state, the legs 112 may be adjusted to provide stability to the partition apparatus 100 by being oriented away from the telescoping body 102 at least partially deployed beneath the base 110. As an example, FIG. 4 depicts the legs 112 oriented in a parallel position relative to the body 102 and perpendicular to the base 110.

Figure 5:
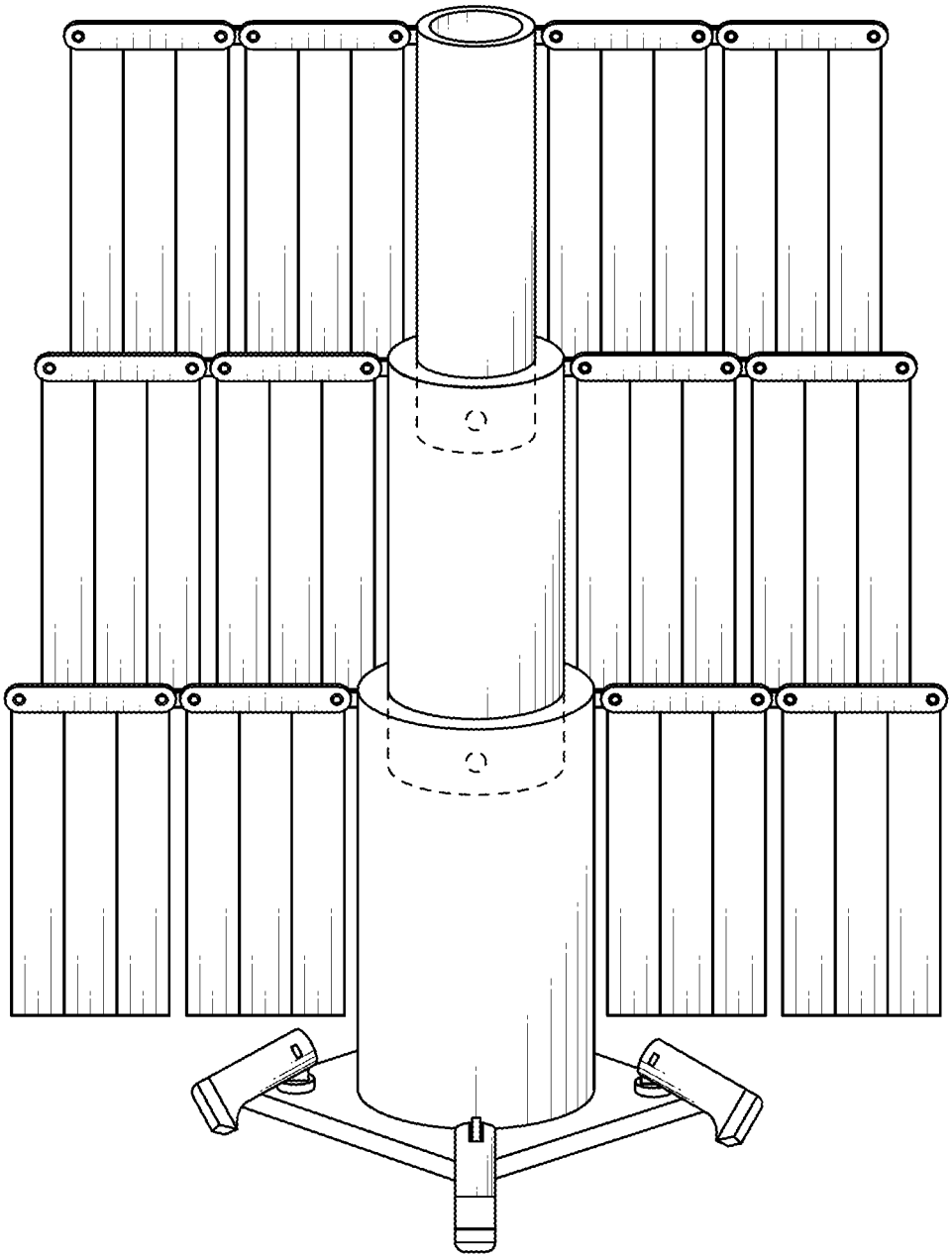
FIG. 5 is a front view of the embodiment of the telescoping partition apparatus of FIG. 4 in a fully deployed configuration wherein the hinged inner arms are extended in a straight line and the partition wall curtain is fully extended.

Referring to FIG. 5, the partition apparatus 100 of FIG. 4 is illustrated in a fully deployed configuration. In this configuration the adjustable partition top frames 140A-140C and 142A-142C may remain at a perpendicular orientation relative to the telescoping body 102 or be rotated to that position by hinges 144A-144F, while the adjustable partition side frames 146A-146C and 148A-148C may be placed in a fully deployed configuration by rotating them 90 degrees about the second set of hinges 150A-150F such that they are oriented in a perpendicular orientation relative to the telescoping body 102 and the angle between the adjustable partition side frames 146A-146C and 148A-148C with their respective adjustable partition top frame 140A-140C and 142A-142C may be around 180 degrees. For example, both adjustable partition top frame 140A and adjustable partition side frame 146A are depicted in a perpendicular orientation relative to the telescoping body 102 while the angle between them is 180 degrees.

In the fully deployed configuration of FIG. 5, the first set of wall curtains 152A-152F may be fully unfurled or otherwise fully deployed from the adjustable partition top frames 140A-140C and 142A-142C, and the second set of wall curtains 154A-154F may also be fully unfurled or otherwise fully deployed from the adjustable partition side frames 146A-146C and 148A-148C. The first set of wall curtains 152A-152F and the second set of wall curtains 154A-154F may be oriented with respect to each other such that they hang unfurled in the same plane such that one curtain does not overlap over the other. For example, wall curtain 152A is shown in the same plane as wall curtain 154A and hangs neither behind nor in front of wall curtain 154A. Further, there may exist a gap between each of the first set of wall curtains 152A-152F and the second set of wall curtains 154A-154F. For example, a gap is depicted between wall curtain 152A and wall curtain 154A.

FIG. 5 further depicts the first pole 104, the second pole 106, and the third pole 108 fully deployed such that the second pole 106 extends fully from the opening 109A and is at least partially surrounded by the first pole 104, and the third pole 108 extends fully from the opening 109B and is at least partially surrounded by the second pole 106. When the partition apparatus 100 is in the fully deployed state, the legs 112 may be adjusted to provide stability to the partition apparatus 100 by being oriented away from the body 102 at least partially deployed beneath the base 110.

In some embodiments, when deployed and completely unfurled, the first set of wall curtains 152A-152F and the second set of wall curtains 154A-154F may each be of the same lengths or different lengths, and may be of the same widths or different widths. For example, in some embodiments, the second set of wall curtains 154A-154F may be of a shorter width or length than the first set of wall curtains 152A-152F. In other embodiments, the length of each of the first set of wall curtains 152A-152F and the second set of wall curtains 154A-154F is progressively shorter the higher in elevation relative to the base 110. For example, in some embodiments curtain 152A may be longer than curtain 152B which may be longer than curtain 152C. In some embodiments the first set of wall curtains 152A-152F and the second set of wall curtains 154A-154F may each be configured to layer when unfurled such that, for example, curtain 152A is layered in front of curtain 152B which is layered in front of curtain 152C.

The partition apparatus described herein may take the form of different embodiments. These embodiments are provided for illustrative purposes and intended to be an exemplification of the principles of the novel disclosure, and as such are not intended to limit the aspects of the specific embodiments illustrated herein. The features, structures, or characteristics disclosed in any one embodiment, for example, may be rearranged or combined with the features, structures or characteristics in any other embodiment. One skilled in the relevant art will also recognize that the embodiments may be implemented without one or more of the specific details, or with other methods, components, materials, and so forth.

What is claimed is:

1. An apparatus for providing a portable privacy partition, comprising:

a base;

a body extending from a first surface of the base, the body including a plurality of poles configured to telescope relative to one another and the base so as to form a predetermined height over the base;

an extension arm including a proximal end coupled to a lateral side of the body via a hinge and a distal end opposite the first end, the hinge accommodating positioning of the distal end of the extension arm to a predetermined location relative to the body;

an inner arm engaged to the extension arm with at least a portion of the inner arm configured to extend from the distal end of the extension arm, wherein the inner arm comprises a hinge configured to bend up to 360 degrees; and a first curtain positioned along the inner arm and second curtain positioned along the extension arm, each of the first curtain and the second curtain deployable to occupy a space adjacent the body.

2. The apparatus of claim 1, further comprising:

a plurality of legs coupled to the first surface of the base, each of the plurality of legs including a fixed end coupled to the first surface via a hinge, and a free end defined opposite the fixed end, the hinge accommodating repositioning of the free end of the leg relative to the base such that the leg extends adjacent to a second end of the base opposite a first end.

3. The apparatus of claim 1, wherein the body includes a pin hole for securing at least one of the plurality of poles in a fixed position relative to the base.

4. The apparatus of claim 1, wherein the inner arm is configured to swivel relative to the extension arm.

5. The apparatus of claim 1, wherein the first curtain is configured to have an adjustable length.

6. The apparatus of claim 1, wherein the first curtain is configured to have an adjustable width relative to a position of the inner arm.

7. A method of manufacturing a portable privacy partition apparatus comprising;

providing a base defining a flat surface;

engaging a plurality of posts to the base, the post being adapted to telescope relative to the base to a predetermined height above the base;

coupling an extension arm along at least one of the plurality of posts, the extension arm configured to extend horizontally orthogonally relative to the post;

coupling an inner arm to the extension arm, wherein the inner arm is configured to comprise a hinge configured to bend up to 360 degrees; and positioning a curtain along the inner arm, the curtain configured to deploy from the inner arm to occupy a space adjacent the plurality of posts.

8. The method of claim 7, further comprising:

coupling a plurality of legs to the base via a hinge mechanism that accommodates raising or lowering each of the plurality of legs relative to the base.

9. The method of claim 7, wherein the inner arm is configured to swivel relative to the extension arm.

10. The method of claim 7, wherein the extension arm is configured to comprise a hinge configured to bend up to 180 degrees.

11. The method of claim 7, wherein the curtain is configured to have an adjustable length.

12. The method of claim 7, wherein the curtain is configured to have an adjustable width relative to a position of the inner arm.

13. An apparatus for providing a portable privacy partition, comprising:

a base;

a body extending from a first surface of the base, the body configured to telescope relative to the base to form a predetermined height over the base;

an adjustable partition top frame rotatably coupled along a lateral side of the body by a first hinge and configured to rotate relative to the first hinge;

an adjustable partition side frame rotatably coupled to the adjustable partition top frame by a second hinge and configured to rotate from the second hinge; and a curtain positioned along the adjustable partition top frame and deployable from the adjustable partition side frame to occupy a space adjacent the body.

14. The apparatus of claim 13, wherein the first hinge coupling the adjustable partition top frame to the lateral side of the body is configured to bend between 90 degrees and up to 180 degrees relative to the body.

15. The apparatus of claim 13, wherein the second hinge coupling the adjustable partition side frame to the adjustable partition top frame is configured to bend between 90 degrees and up to 360 degrees relative to the adjustable partition top frame.

16. The apparatus of claim 13, wherein measurements of the curtain are determined by the measurements of the adjustable partition top frame and the adjustable partition side frame.

17. The apparatus of claim 13, wherein the curtain is configured for a user to adjust a length of the curtain and width by pulling the curtain.

18. The apparatus of claim 13, wherein when the apparatus assumes a fully extended state the adjustable partition top frame is fully extended horizontally and assumes a 90 degree angle relative to the body, and the adjustable partition side frame is fully extended horizontally and assumes a 90 degree angle relative to the body.

* * * * *